United States Patent [19]

Andrews, Jr.

[11] 4,023,769

[45] May 17, 1977

[54] MOLDING MEANS HAVING OPPOSED CORE ASSEMBLIES

[75] Inventor: Ray T. Andrews, Jr., Clear Lake, Iowa

[73] Assignee: Andrew Corporation, Clear Lake, Iowa

[22] Filed: Nov. 22, 1972

[21] Appl. No.: 308,646

[52] U.S. Cl. ..... 249/64; 249/162; 425/438; 425/468

[51] Int. Cl.[2] ..... B28B 7/16

[58] Field of Search ..... 425/262, 441, 450, 457, 425/468–469, DIG. 5, 438, 444; 249/63, 142, 147, 175–177, 160–162, 64; 264/334, 336

[56] References Cited

UNITED STATES PATENTS

| | | | |
|---|---|---|---|
| 419,187 | 1/1890 | Curry et al. | 249/178 |
| 947,116 | 1/1910 | Miller | 249/142 |
| 990,286 | 4/1911 | Murray et al. | 249/178 |
| 2,460,167 | 1/1949 | Carlsen | 249/162 |
| 2,521,520 | 9/1950 | Jancura | 249/162 |
| 2,630,614 | 3/1953 | Peterson | 249/99 |
| 3,316,607 | 5/1967 | Kroll | 249/205 |
| 3,433,450 | 3/1969 | Brunner et al. | 425/444 |
| 3,584,111 | 6/1971 | Allison | 425/438 |
| 3,662,438 | 5/1972 | Koyama | 249/63 |

*Primary Examiner*—Francis S. Husar

*Assistant Examiner*—John McQuade

*Attorney, Agent, or Firm*—Burns, Doane, Swecker & Mathis

[57] ABSTRACT

A method and apparatus for making concrete slabs to be used in the construction of walls or floors in buildings. The slabs can be made of desired thickness as, for example, from 8 inches to 24 inches and of lengths which also are optional as, for example, from 8 feet to 12 feet. Assemblies of core members are disposed on opposite sides of a cavity, to be moved back and forth with respect to the cavity for molding recesses in opposite edges of a slab and to be retracted therefrom when the concrete has set to the desired extent. The mold assemblies each comprises a plurality of core members spaced longitudinally of the cavity and when moved to inner positions will leave an open space therebetween for molding a central web in the slab, with transverse webs extending out to the lateral edges of the slab. Additional core members may be disposed between the main core members. The small core members will form longitudinal openings through the slab. The release of the mold assemblies is in two steps. Initially, a wedging action or other means moves the core members just sufficient to break the seal with the formed slab in the recess thereof and thereafter hydraulic jacks are used to retract the mold assemblies.

10 Claims, 14 Drawing Figures

MOLDING MEANS HAVING OPPOSED CORE ASSEMBLIES

SUMMARY OF THE INVENTION

This invention relates to improvements in apparatus for making concrete building slabs such as may be used for floors or walls.

It has been the practice heretofore to mold concrete slabs either by extrusion or by molding around forms, but the large slabs used for walls and floors of buildings have required very complex and expensive machinery. Moreover, there have been various objections to the product and limitations of its size. For example, in molding floor or roof slabs with cores formed therethrough, it is frequently necessary to raise the slabs and dump the contents from the cores. If such slabs are made thick, above 12 inches, there is danger that the slabs would fall in at the cores. Extrusion molding is often practiced, but involves very expensive equipment which is large in size and area and has many objections in practice.

One object of this invention is to obviate these objections and to improve the apparatus for making large building slabs suitable for either walls or floors of a building construction.

Another object of the invention is to provide for the molding of concrete slabs of improved construction formed with longitudinal and transverse webs of great structural strength and yet may be molded substantially to any desired size, thickness and length.

Still another object of the invention is to provide for the molding of concrete slabs for building constructions which will have the strength needed with no sagging or falling in over the cores therein, and yet may be provided with cores through the slabs as well as transversely thereof.

A further object of the invention is to provide for the molding of concrete building slabs of desired dimensions with a minimum investment in equipment needed for the installation.

These objects may be accomplished, according to one embodiment of the invention, by providing a relatively pan or form of a length according to the desired length of the slab to be formed. Mounted in operative position over opposite edges of the pan or form are assemblies of core members spaced apart from each other lengthwise of the pan or form and may have additional smaller core members between the spaced core members. The mold assemblies are mounted for movement toward and from each other to positions spaced apart to form a longitudinal web through the molded slab and with transverse webs between the spaced core members. The mold assemblies are moved bodily to retracted and to molding positions by suitable power means, such as hydraulic jacks. The initial separation of the mold members from the cavities in opposite edges of the slabs is accomplished in a separate step by suitable power means such, for example, as wedging.

The welding action is provided by a reciprocating member that extends lengthwise of each mold assembly into wedging relation with rollers mounted on spaced ears or brackets connected with the rail of each mold assembly. The action is sufficient to cause a slight initial bodily movement of the core members sufficient to release the surfaces thereof from the surfaces of the recesses formed in the slab. Additional means may be used in conjunction therewith to retain the slab against bodily displacement during this wedging action.

BRIEF DESCRIPTION OF THE DRAWINGS

This embodiment of the invention is illustrated in the accompanying drawings, in which.

DETAILED DESCRIPTION OF DISCLOSURE

Figures 12, 13:
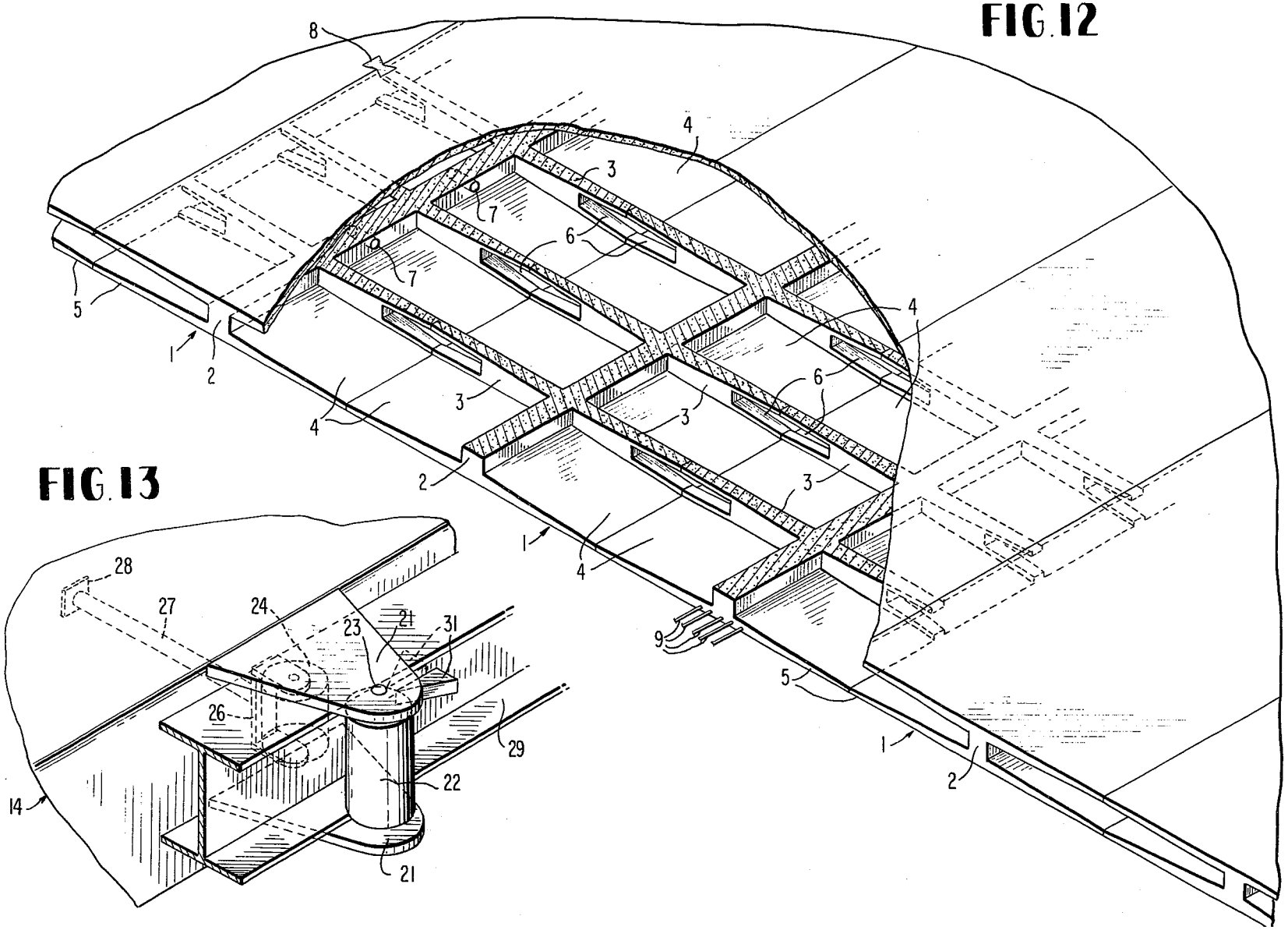
FIG. 12 is a perspective view of an assembly of building slabs, with parts broken away and in section.
FIG. 13 is a perspective view of the wedging means for effecting initial release of the core members from the recesses in the slab.

A slab made according to the process and apparatus here described is illustrated generally in FIG. 12 used with companion slabs in a floor. It may be used as well for walls by standing the slabs on end or in upright positions.

As here illustrated, the slab is designated generally by the numeral 1 and, for example, may have dimensions that vary according to the building requirements. As an example, the thickness of the slab may be approximately 8 inches to 12 inches, but can be of greater depth such, for example, as 16 inches, 20 inches and even up to 24 inches in depth. The width of the slab may also be optional, such as 4 feet, 8 feet or the like. The length of the slab, as molded, will depend upon the length of the equipment available and the need for various lengths in the building construction. For example, the slabs may be from 12 feet to 24 feet in length or may be molded much longer and then sawed into the desired lengths.

Each slab molded according to this invention has a longitudinal central web 2, with transverse webs 3 intersecting the central web 2. Recesses 4 are provided on opposite sides of the central web 2 and between the transverse webs 3, and extend out to the lateral margins of the slab and formed as cores therein. The upper and lower sides of each recess 4 are enclosed by wall portions 5 tapering in depth from the central web 2 to the lateral margin of the slab. These wall portions 5 abut at the lateral margins of each slab with similar portions to adjacent slabs when these are used in the floor or wall of the building, as indicated generally in FIG. 12.

Longitudinal cores are provided in the transverse webs 3, as indicated at 6. These longitudinal cores 6 preferably extend from the lateral margin of each slab inwardly toward but spaced from the longitudinal web 2. Additional transverse cores may be formed, if desired, through the central web 2, as indicated at 7, for electrical or other ducts as desired.

Any suitable or desired concrete material may be used for forming the slab. For example, it can be poured from a high slump concrete, which would give a desirable finish and would make it easy to place inserts, lifting eyes, or shear steel. As an example of such inserts, I have shown weld plates 8 in FIG. 12 molded in the surfaces of adjacent slabs at the outer ends of the transverse webs 3 which are useful for abutment and welding to obtain proper leveling of floor or roof.

It is customary to provide suitable reinforcing material in the concrete extending lengthwise through the slab, such as prestressing strands, indicated generally at 9 in FIG. 12. The conventional prestressing or reinforcing rods or strands may be used in the slab as found desirable or needed.

Figure 5:
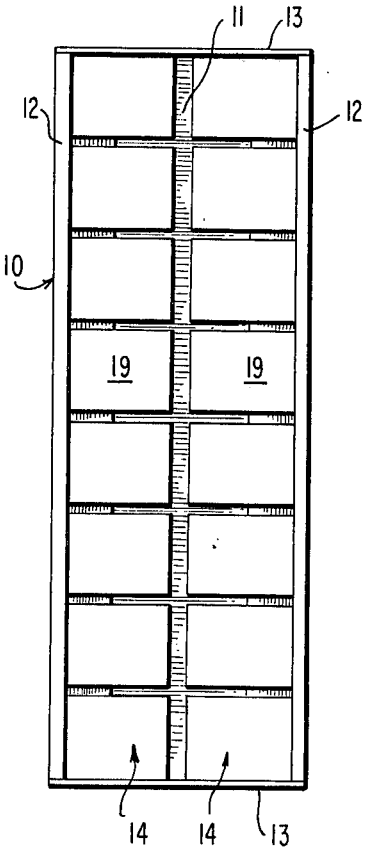
FIG. 5 is a diagrammatic top plan view of the form, with the core members in molding positions.
Figure 6:
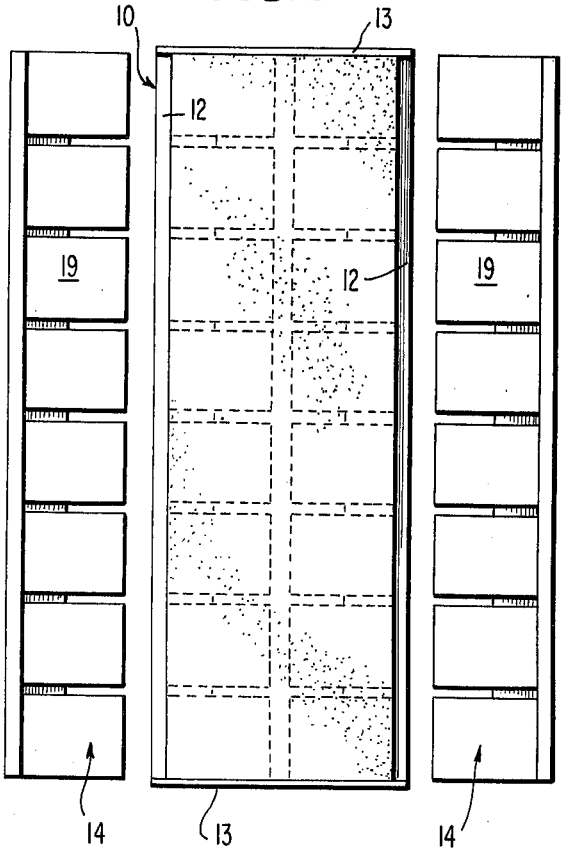
FIG. 6 is a similar view, showing the core members retracted.
Figure 7:
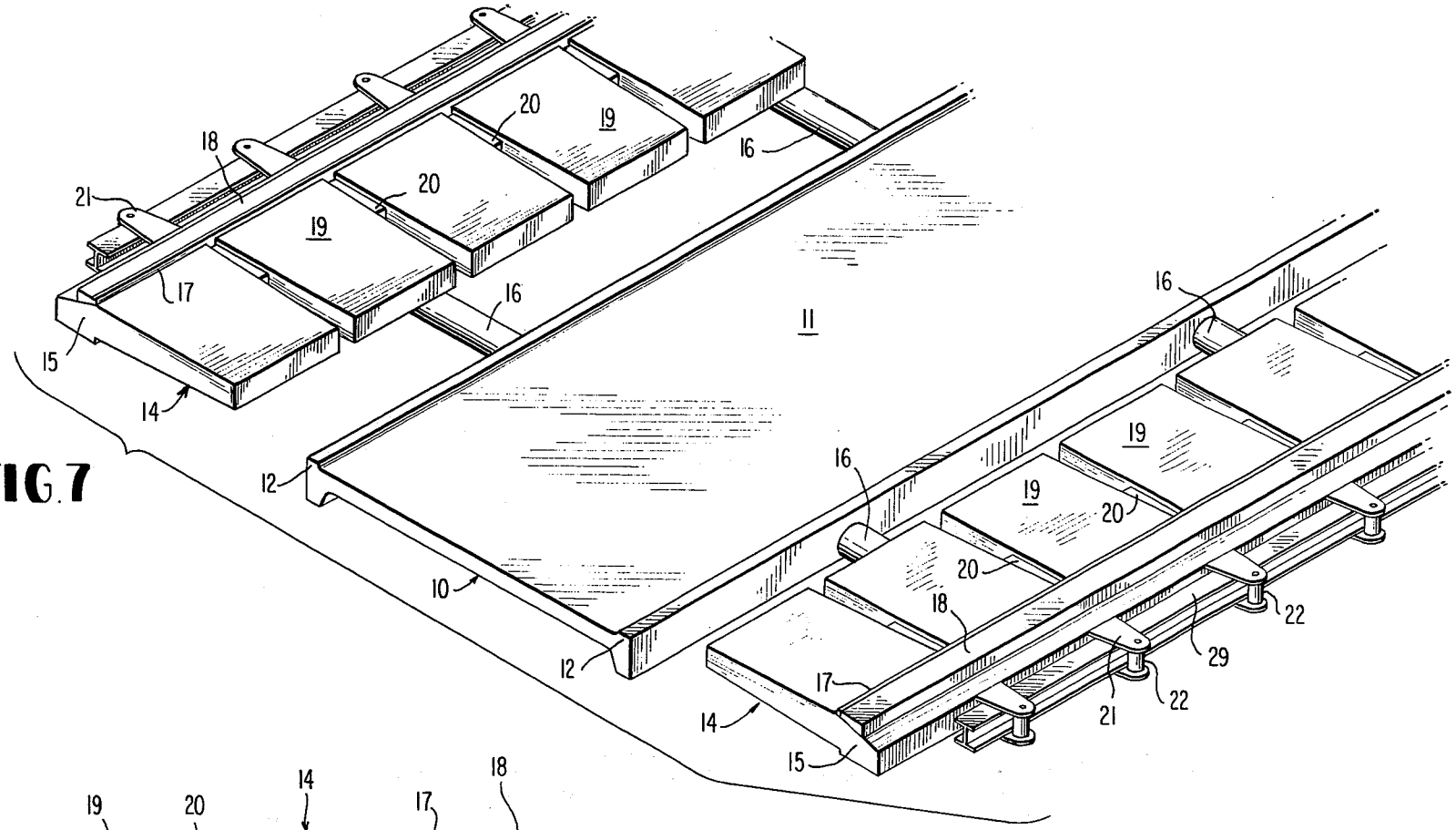
FIG. 7 is a perspective view of the molding apparatus, showing the core members retracted.

The molding apparatus comprises a frame structure, generally indicated at 10, having a shallow pan forming a cavity 11 which extends from side to side in the frame 10 and having wall portions 12 along opposite edges thereof (FIG. 7). End walls 13 will be provided to close the opposite ends of the cavity 11, as shown in FIGS. 5 and 6, but are omitted from some of the drawings for clearness of illustration. The width of the cavity 11 should be sufficient to form one side face on a slab and normally would be flat throughout, but the shape thereof may be varied as found desirable according to the character and nature of the slabs to be formed therein.

Disposed along opposite edges of the cavity 11 above the frame 10 are core assemblies 14, one on each side, capable of being moved in and out to retracted and extended (or molding) positions with respect to the cavity 11. Each of these assemblies 14 comprises a core frame 15 (FIGS. 10 and 11) for supporting an assembly of core members. The core frames 15 of the respectively opposite assemblies are mounted on ram jacks 16 which support the core assemblies 14 for moving the assemblies back and forth between the respective positions shown in FIGS. 7 and 8 or FIGS. 10 and 11. Any suitable or desired form of guides may be used for the assemblies to facilitate the inward and outward movement of the core members.

At the inner edge of each core frame 15 and extending continuously lengthwise above the frame 15 is a shallow wall section 17 serving to close opposite sides of the cavity 11 when the core members are in advanced (molding) positions.

The upper end of each rail 12 has mounted thereon a track member 18 upon which a concrete placing machine can be moved to a desired position over the cavity and over the core members in advanced positions. The track members 18 may be straddled by the concrete placing machine which is rolled therealong in supplying the concrete to the mold.

Figure 10:
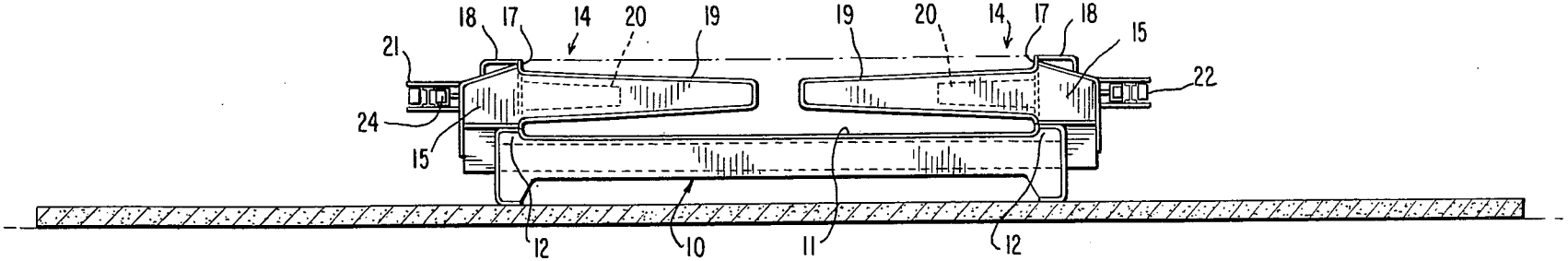
FIG. 10 is an end elevation of the molding apparatus, with the core members advanced in molding positions.

Mounted on each rail 12 and extending inwardly therefrom in longitudinally spaced relation are plurality of core members 19. These members 19 are carried by the rail and extend in cantilever form over the cavity 11, as indicated in FIG. 10. Each of the core members 19 may be formed hollow of sheet metal or of other suitable material and preferably have tapering sides so as to shape the cavities 4 in the opposite edge portions of the slab 1.

Each core member 19 may be formed of steel plates welded together and welded to the core frame 15, or in one piece with the later. The core members 19 may also be made of different shapes and sizes, as desired, according to the shape and size of the recesses 4 to be formed in the slab.

The length of the core members 16 is sufficient so that when moved to their innermost positions, as shown in FIG. 10, the aligned, but spaced, core members will be spaced apart sufficiently so as to form the web 2 in the slab of the desired thickness. The spacing between the core members 19 in each core assembly 41 will provide for the formation of the cross webs 3.

Figure 14:
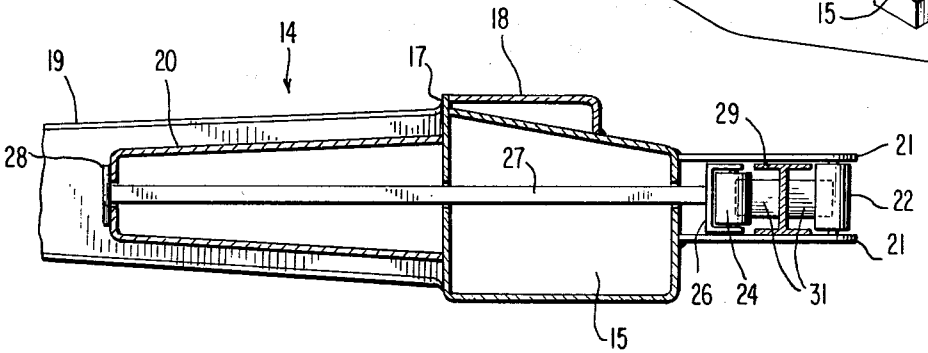
FIG. 14 is a detail elevation of the initial release means.

Additional small core members are shown at 20 disposed between the outer ends of each adjacent pair of core members 19 and extending partway only of the length thereof inwardly from the connected rail 12 (see FIG. 14). These small core members 20 are of less height than the core members 16 so as to provide for the molding of the cores 6 in the transverse ribs 3 of the formed slab.

The bodily movement of the mold assemblies 14 inward and outward with respect to the cavity 11 is accomplished by the actuation of hydraulic jacks 16 when the slab has been formed and after substantial setting of the concrete. This occurs also, preferably, after an initial separation or loosening of the core members from the recesses formed in the slab. Provision is made for this initial loosening action by means located at each opposite side of the cavity 11.

Disposed at points spaced along the length of each frame 15 are pairs of brackets or ears 21 extending outwardly therefrom and rigidly secured to the frame as, for example, by welding or other suitable means. These brackets or ears 21 are spaced apart vertically and have mounted therebetween an outer roller 22 suitably journaled, as on a pin 23, in each pair of brackets or ears 21, as shown more in detail in FIGS. 13 and 14.

A secured roller 24 is mounted within each pair of brackets or ears 21 for freedom of bodily movement transversely. This roller 24 is journaled in a frame 26 mounted on a push rod 27 extending through the frame 15 and the core member 20 and supported thereon and on the small core member 20. A push plate 28 is fixedly mounted on the inner end of the push rod 27 at the inner end of the small core member 20 (see FIG. 14). These push members will be located at desired intervals along the length of each core assembly 14, as for example, at each small core member 20.

Extending parallel with each frame 15 is a reciprocating member 29 shown in the form of a small beam, such as an I-beam, and which is mounted between the pairs of brackets or ears 21, supported by the latter, and capable of reciporcating movement with respect thereto. The reciprocating member 29 also extends between the rollers 22 and 24. Suitable means is attached to the reciprocating member 29 to effect actuation thereof lengthwise parallel with the frame 15 such, for example, as a jack or hydraulic cylinder, generally indicated at 30.

As shown in FIG. 13, the reciprocating member 29 is provided with wedges 31 on opposite sides thereof adjacent the respective rollers 22 and 24. One of the wedges 31 is in position to engage the roller 22 upon reciprocating movement of the member 29 and the other wedge 31 is in position to engage the other roller 24 with a wedging action therebetween. Other alternate means (not shown) may be used to effect actuation of the push rods 27, as by an air or hydraulic cylinder connected thereto.

The molding of the concrete around the core members 19 and 20, will cause surface adhesion between the concrete slab and the core members, tending to resist the removal of the core members from the cavities in the molded slab. However, this adhesion can be broken for the free withdrawal of the core members by the adhesion breaking and initial separation means here described.

Thus, the reciprocating member 29 is actuated to effect initial separation of the faces of the core members 19 from the cavities 4 in the formed slab. This causes an initial retraction of the core members, and the plates 28 will be held abutting against the ends of the formed cores 6 in the cross web 3 of the slab. This will hold the slab in place in the cavity 11 during this initial releasing of the core member. A number of these devices can be used to effect such releasing action, as, one for each pair of brackets or ears 21 spaced along the length of each member 15. This action takes place as the mold assemblies are initially retracted and before action by the hydraulic jacks 16.

Figure 11:
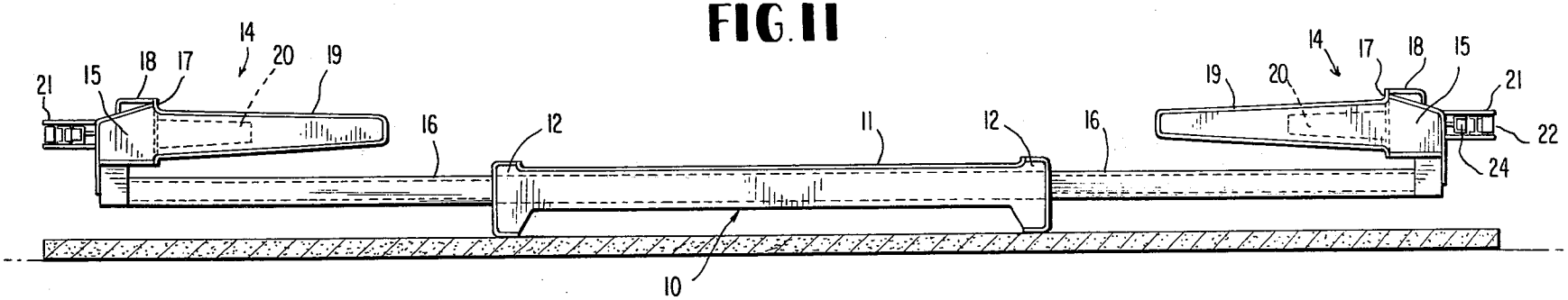
FIG. 11 is a similar view, showing the core members retracted.

Thereafter, the jacks 16 are actuated to remove the assemblies 14 to the retracted positions shown in FIGS. 7 and 11 of the drawings, when the core members 19 and 20 will be retracted from the cavities 4 in opposite edges of the formed slab 1, and thus allow the slab to be removed from the mold.

Figure 9:
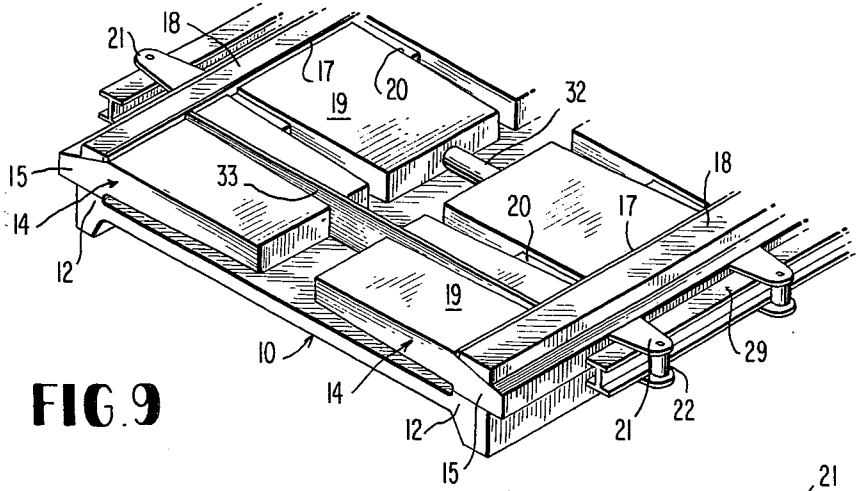
FIG. 9 is a perspective view illustrating a modification of the mold assembly.

If it is desired to form cross cores in the central web 2 of the slab, as indicated at 7 in FIG. 12, additional core members (not shown) may be provided on the inner end or ends of the core members 19, as indicated at 32 in FIG. 9. These core members 32 may be of any desired size or shape. In some cases, these may form round openings for pipes, or long narrow openings for heating or air conditioning ducts. The openings can be formed in a variety of ways, as by pipe or sheet metal sleeves, pieces of plastic or other material that can be knocked out after use, etc.

The end walls 13 of the frame 10 of the form will limit the longitudinal extent of the formed slab. If it is desired to make slabs of less than the full length of the form, this may be provided by one or more bulkheads 33 mounted therein upon and between the core members 19, as shown in FIG. 9, or by sawing the formed slabs into lengths with a conventional concrete saw.

Figure 8:
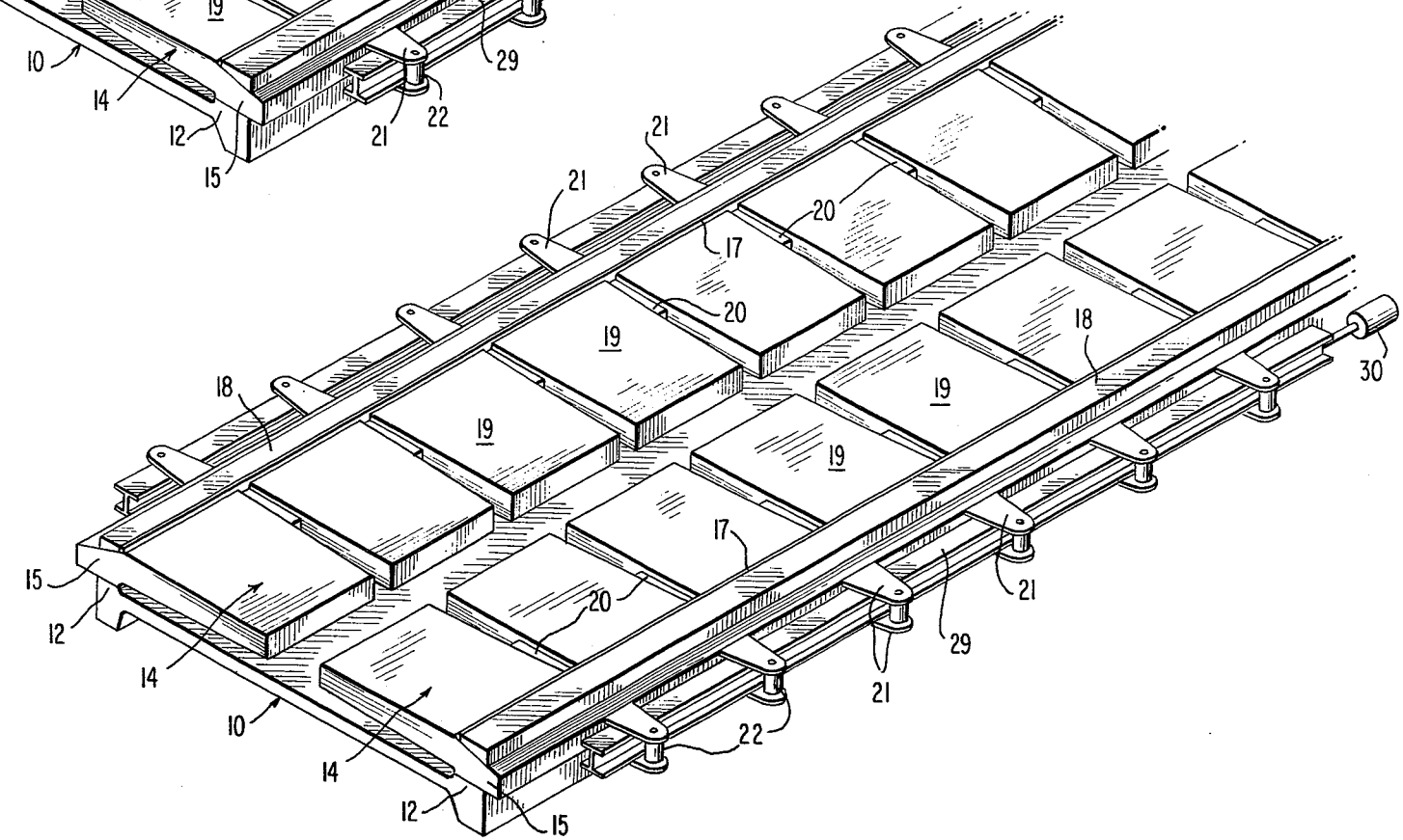
FIG. 8 is a similar view, showing the core members advanced to molding positions.

The method of making a concrete slab according to this invention comprises the steps of initially retracting the mold assemblies from over the cavity in the frame 10, as illutrated in FIGS. 6 and 8, then cleaning and preparing the bed frame 10 for casing. The bulkheads 33, if used, are placed at desired intervals in the cavity 11; if the slabs are to be sawed to length, the bulkheads are not required.

With the core members retracted, as in FIGS. 6 and 7, the desired prestressing strands, as indicated at 9 (FIG. 12), are placed in the cavity 11, and are stretched or tightened. Any additional reinforcing material or weld plates, such as are indicated at 8 (FIG. 12), should also be placed and secured in position.

Figure 1:
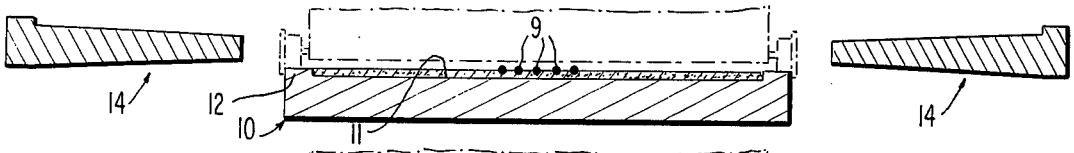
FIG. 1 is a diagrammatic end view showing the mold assemblies in position over the pan or form in the first step of molding.
Figure 2:
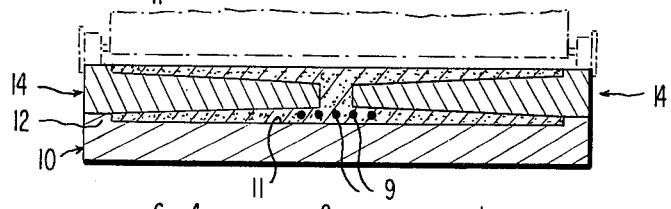
FIG. 2 is a similar view, showing the completed molding operation.
Figure 3:
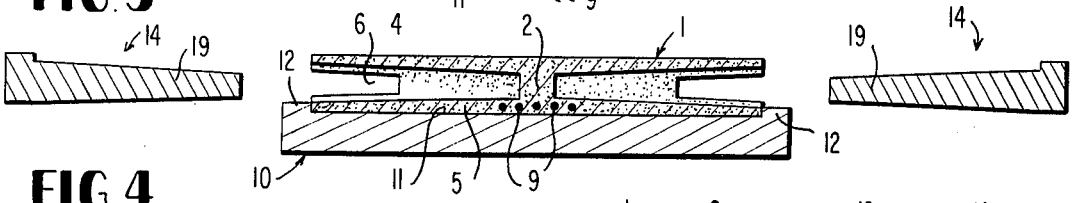
FIG. 3 is a similar view, showing the release of the core members from the recesses in the slab.
Figure 4:
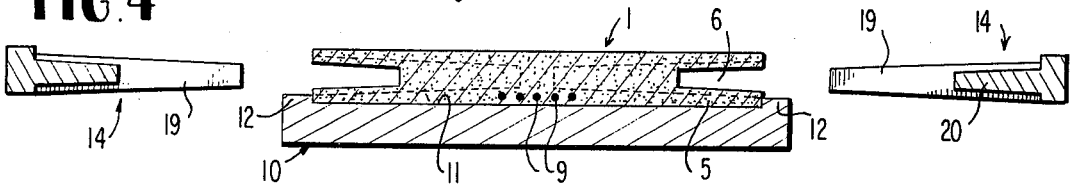
FIG. 4 is a similar view through the transverse web and showing the core members retracted.

A layer of concrete is then poured in the bottom of the cavity 11 by progressive movement of the concrete mixer or equipment along the length of the frame on the track members 17. This pouring fills the bottom of the cavity 11 to the height of the upturned opposite edges 12 of the cavity at the upper edge of the frame 10, substantially as illustrated in FIG. 1. This layer of concrete can be vibrated in the conventional manner. Then the hydraulic jacks 18 are actuated to move the mold assemblies 14 inward with the core members 19 and 20 projecting over the initial layer of concrete substantially as also illustrated in FIG. 1. Any additional required reinforcing or weld plates are then secured in the top portion of the mold.

Then the remainder of the concrete can be poured into the cavity over and upon the core members 19 and 20, filling the cavity to the upper edge of the wall members 15, normally in a level relation. A vibrator may also be used, after the top portion of the slab is poured, to facilitate the spreading and settling of the concrete in the cavity of the mold.

After the concrete is hardened to the desired extent, the core members 19 and 20 are released by a reciprocating motion imparted to the bar member 29 upon actuation of the jack 30 or by any optional means, such as a hydraulic cylinder, to effect initial release of the core members from the recesses in the slab. After the core members are thus used released, the hydraulic cylinders 16 are actuated to move the core members 19 and 20 to completely open positions, shown in FIG. 7. Then the formed slab can be sawed, if the bulkheads 33 are not used, or the latter removed and the prestressing strands should also be cut.

The completed product or products may then be removed from the cavity 11 and the process started over again as described.

The twin core plant, according to this application, is unique from others in that it is manufactured in a specially designed form which makes the cores by moving the sides of the form in and out. The core is formed by a steel box-like structure running transverse to the product and is moved in and out by a wedging and hydraulic mechanism. It is unique from others which have cores running longitudinally, in that the product can have cores both longitudinally and transversely.

The advantages of the twin core slab include:

1. Cores can run in both directions.

2. Due to this method of manufacturing, slabs can be of any depth. Due to the fact that the cores in this slab are made with a form, greater depth slabs can be made, such as 16, inches, 20 inches and even 24 inches. This would allow longer spans and greater load carrying capacities. 3. The tops of the slabs can be made to be superior since there will be no sagging over the voids as in an extruded process. 4. The 8 foot width is a definite advantage which will result in cheaper labor cost in manufacturing, hauling, and erection. Also there is a definite advantage when slabs are used for wall panels, fewer joints, etc.

5. This slab can be poured with a high slump concrete which should give a better finish and will make it easier to place inserts, lifting eyes, and shear steel.

6. Due to the core arrangement, it can have better coverage of strands for fire protection, thus having better fire ratings.

7. This slab can be made very easily with a minimum investment of only a short form. No elaborate equipment is needed for an initial installation such as with the other systems; thus many producers can get into the hollow core business that otherwise could not afford to do so.

8. This system can be automated for lower labor costs as the cores are operated with a hydraulic and wedging system mechanism and a placing machine could be added for a fully automated system.

While the invention has been illustrated and described in certain embodiments, it is recognized that other variations and changes may be made therein without departing from the invention set forth in the claims.

I claim:

1. Apparatus for making building slabs comprising means forming an elongated mold cavity, an elongated core assembly extending along each opposite side of the mold cavity, each core assembly including a plurality of core members spaced along the length of the assembly and extending transversely thereof, the core assemblies having inner ends of the core members of opposite core assemblies spaced apart transversely of the mold cavity, means for moving the core assemblies toward each other in opposed spaced relation to positions with the inner ends of the core members of opposite core assemblies spaced apart transversely of the cavity forming means for molding a slab around the core members with a longitudinally extending web and with recesses on opposite sides of the web spaced along the length of the slab, additional core members intermediate the core members of each assembly and extending from one core member to the next adjacent core member closing the space therebetween, said intermediate core members extending from the outer ends of the adjacent core members toward but spaced from the inner ends thereof providing vertically spaced unsupported webs on the outer edges of the slab, the core moving means including means for retracting the respective core assemblies from the mold cavity.

2. Apparatus for making building slabs according to claim 1, including initial retracting means operative before release of the core members from the recesses by the first-mentioned retracting means.

3. Apparatus for making building slabs according to claim 1, wherein the mold cavity is open and unobstructed between the inner ends of the core assemblies to receive moldable material in a solid mass therebetween, and a rail extending longitudinally along the cavity and movable transversely toward and from an edge portion of the cavity with the core members carried by the rail and projecting inwardly over the cavity when the rail is at an edge thereof.

4. Apparatus for making building slabs according to claim 1 including adhesion breaking means carried by the core members at the edge of the mold cavity in position for abutting relation with the formed slab and means for actuating the adhesion breaking means for holding the slab in the cavity during the initial retraction of the core assembly.

5. Apparatus for making building slabs comprising means forming an elongated mold cavity, a core assembly extending along each opposite side of the mold cavity, each more assembly including a plurality of core members spaced apart lengthwise to the mold cavity, means for moving the core assemblies toward each other to positions with the core members spaced apart for molding a slab around the core members and having a longitudinally extending web therebetween with recesses on opposite sides of the web, means for initially separating the core members in the respective recesses from the slab additional means for retracting the respective core assemblies from the mold cavity, wherein each core assembly has vertically spaced brackets extending outwardly therefrom at longitudinally spaced points, means operatively connected with the brackets for moving the core assembly to effect initial release of the core members from the slab, and wherein the operating means includes rollers connected with the brackets, a reciprocating member extending lengthwise of the core assembly and wedging means on the reciprocating member in position to act on the rollers to move the core assembly.

6. Apparatus for making building slabs, comprising means forming an elongated shallow cavity, rails extending lengthwise of opposite edges of the cavity, core members carried by each of the rails and spaced apart lengthwise thereof, the core members extending inwardly above the cavity and of a length to project from each rail in a position at the lateral edge of the cavity partway only toward the transverse center of the cavity to form a longitudinal central web in the slab, the longitudinal spacing of the core members forming transverse webs in the slab, means mounting the rails for movement toward and from the lateral edges of the cavity, members lengthwise of the rails, brackets carried by each rail in embracing relation with each lengthwise member and having a connected roller on the opposite side of the member from the rail, and wedge means carried by the member in position to act on the roller to effect initial movement of the rail an core members.

7. Apparatus for making building slabs according to claim 6, including a release member movable transversely of the rail in position to abut laterally against a portion of the slab, and wedging means on the lengthwise member for actuating the release member.

8. Apparatus for making building slabs comprising: means forming an elongated mold cavity, a core at one side of the mold cavity, means for moving the core toward the opposite side of the mold cavity to a position spaced therefrom for molding a slab in the cavity and for retracting the core from the mold cavity, means at a side of the cavity in position for abutting relation with a portion of the formed slab and slidable relative to the core, and means separate from the retracting for applying positive holding pressure to the abutting means for holding the slab in place in the cavity during the initial retraction of the core to break the adhesion between the core and the slab, the mold cavity being elongated and the core is an elongated assembly, the cavity and core having opposed surfaces for forming therebetween an elongated slab having a longitudinally extending web with recesses on a side of the web, and the adhesion breaking means is in position to engage the web.

9. Apparatus for making building slabs according to claim 8 wherein: the adhesion breaking means includes a plurality of spaced apart pushing members provided on the core and movable relative to the core, and means for holding the pushing members stationary during the retraction of the core.

10. Apparatus for making slabs comprising: means forming an elongated mold cavity, a core at one side of the mold cavity, means for moving the core toward the opposite side of the mold cavity to a position spaced therefrom for molding a slab in the cavity, and for retracting the core from the mold cavity, means at a side of the cavity in position for abutting relation with a portion of the formed slab and slidable relative to the core, and means separate from the retracting means for applying positive holding pressure to the abutting means for holding the slab in place in the cavity during the initial retraction of the core to break the adhesion between the core and the slab, the slab holding means including a push rod extending slidably through the core and a plate carried by the push rod in position for engaging in slab.

* * * * *